US006550128B1

(12) United States Patent
Lorenz

(10) Patent No.: US 6,550,128 B1
(45) Date of Patent: Apr. 22, 2003

(54) APPARATUS AND METHOD FOR HANDLING OF TUBULARS

(75) Inventor: Georg Lorenz, Burgwedel (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/600,764

(22) PCT Filed: Feb. 11, 1999

(86) PCT No.: PCT/GB99/00432

§ 371 (c)(1),
(2), (4) Date: Sep. 19, 2000

(87) PCT Pub. No.: WO99/41486

PCT Pub. Date: Aug. 19, 1999

(30) Foreign Application Priority Data

Feb. 14, 1998 (GB) ..... 9803115

(51) Int. Cl.[7] ..... B25B 27/00; E21B 19/18

(52) U.S. Cl. ..... 29/464; 559/272; 559/281.1; 269/43; 269/44; 269/45; 166/77.51; 414/22.71

(58) Field of Search ..... 29/559, 272, 281.1, 29/281.5, 282, 464, 466, 468; 166/77.51, 85.1, 85.5, 379, 380, 381, 382, 383; 414/22.63, 22.65, 22.68, 22.71; 269/43, 44, 45

(56) References Cited

U.S. PATENT DOCUMENTS 731,665 A * 6/1903 Clayton
2,147,002 A * 2/1939 Volpin
3,633,771 A * 1/1972 Woolslayer et al.
4,074,897 A * 2/1978 Behn
4,291,762 A * 9/1981 Gudgel
4,295,527 A * 10/1981 Russe
4,442,892 A * 4/1984 Delesandri
4,575,061 A * 3/1986 Dille
4,625,796 A * 12/1986 Boyadjieff
4,650,235 A * 3/1987 Shaginian et al.
4,652,195 A * 3/1987 McArthur
4,750,662 A * 6/1988 Kagimoto
4,769,889 A * 9/1988 Landman et al.
4,779,856 A * 10/1988 Beeler
4,834,604 A * 5/1989 Brittain et al.
5,060,542 A * 10/1991 Hauk
5,206,980 A * 5/1993 Chapman
5,255,751 A * 10/1993 Stogner
5,575,344 A * 11/1996 Wireman
5,575,416 A * 11/1996 Oellerer et al.
5,727,778 A * 3/1998 Nodart
5,806,589 A * 9/1998 Lang

* cited by examiner

*Primary Examiner*—I Cuda Rosenbaum
*Assistant Examiner*—Eric Compton
(74) *Attorney, Agent, or Firm*—Moser, Patterson & Sheridan, L.L.P.

(57) ABSTRACT

An apparatus for attachment to a pipe handling arm, which apparatus comprises a clamp (3, 4) for gripping a tubular (70), characterised in that said apparatus further comprises means (10) for, in use, aligning said tubular (70) with another tubular (71) prior to connection thereof.

38 Claims, 2 Drawing Sheets

APPARATUS AND METHOD FOR HANDLING OF TUBULARS

Figure 1A:
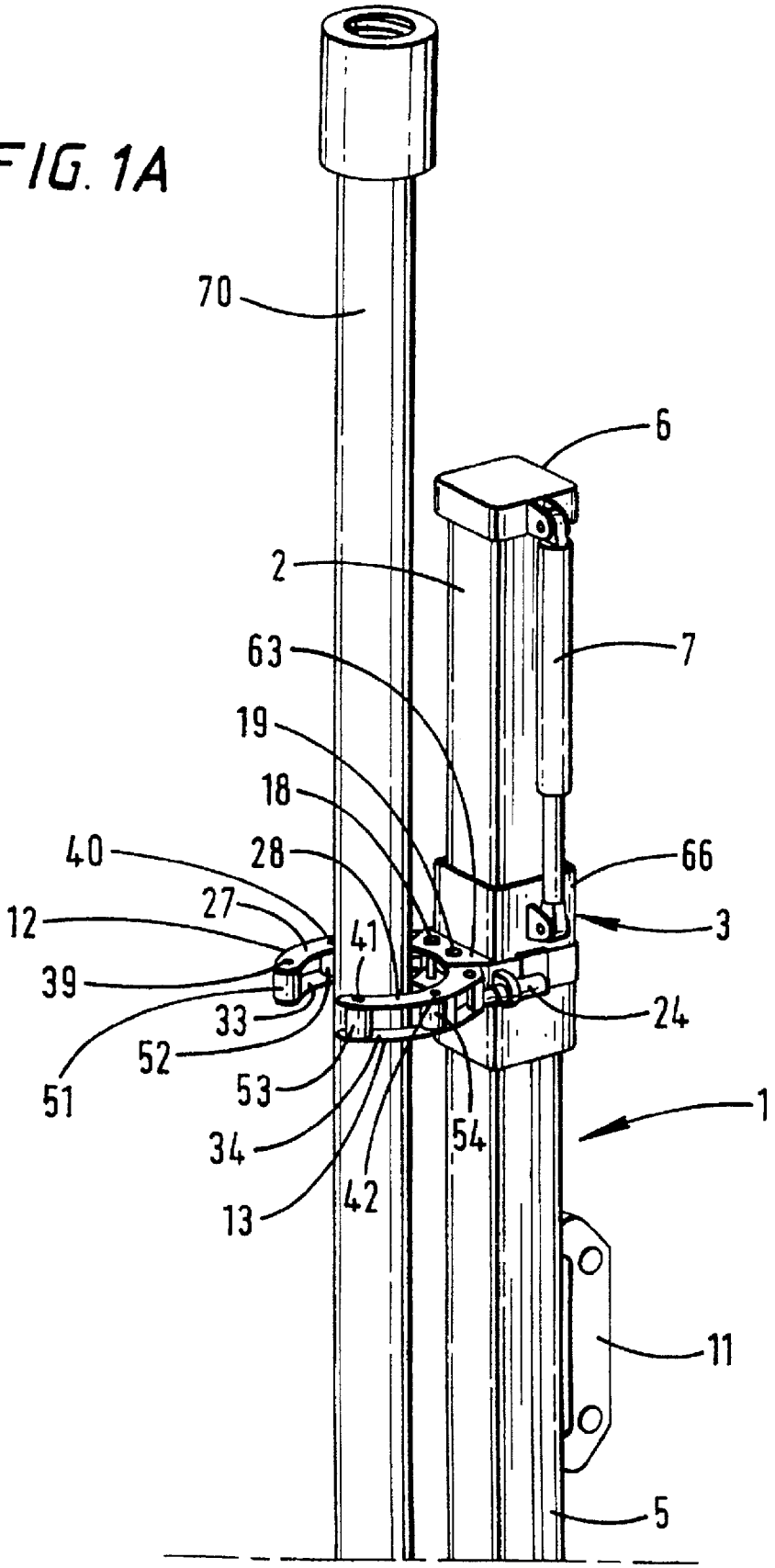

This invention relates to an apparatus for attachment to a pipe handling arm and to a method of handling tubular.

Pipe handling apparatus generally comprises a pipe handling arm and a clamp. The pipe handling arm is fixed at one end to a derrick or to a rig floor of a drilling rig. The other end of the pipe handling arm is free to move in at least one plane, and usually two or three planes. The clamp is attached to the free end of the pipe handling arm. In use, the free end of the pipe handling arm is swung over to a pipe rack. The clamp clamps on to a tubular and then picks the tubular up and manoeuvres it into a position generally over an upper section of a tubular string at the well centre. Typically the tubulars are not in perfect alignment due to tolerance in the pipe handling arm. In order to ensure correct alignment a stabbing guide is then strapped around the threaded box of the upper section of the tubular string. The threaded pin of the tubular is then lowered into the threaded box of the upper section of the tubular string, and is guided into alignment therewith by the stabbing guide.

Although it only takes a relatively short time to mount and remove a stabbing guide it would be desirable to reduce this time because of the high costs associated with the running of a drilling rig.

U.S. Pat. No. 4,625,796 discloses a system for aligning tubulars in which the tubular to be connected is transferred to two jaws mounted on a derrick via parallel arms.

U.S. Pat. No. 4,650,235 discloses an attachment for a pipe handling arm where a tubular is allowed to move through centering jaws.

The present invention provides an apparatus for attachment to a pipe handling arm, comprising a clamp for gripping a tubular and a guide for aligning said tubular with another tubular prior to connection thereof, characterised in that said clamp and said guide are movable relative to each other in a direction longitudinal of the tubular, the arrangement being such that said tubular can be brought closer to said another tubular in a direction longitudinal of the tubular.

The tubulars could be casing, liner or other type of pipe and especially large diameter tubulars, for example 36" casing.

Preferably, said clamp and said guide arranged on a strut.

Advantageously, at least one of said clamp and said guide is moveable along said strut by a hydraulic piston and cylinder.

Alternatively, at least one of said clamp and said guide is movable along said strut by a pneumatic piston and cylinder.

Preferably, said strut is divided into a first portion and a second portion and said second portion is offset from said first portion.

Advantageously, said apparatus further comprises a second clamp which is in a fixed relation to said clamp.

Preferably, said clamp(s) comprise jaws movable between an open and a closed position.

Advantageously, said apparatus further comprises a hydraulic piston to move said jaws between their open and closed positions.

Preferably, said jaws comprise cylindrical rollers, to facilitate rotation of said tubular whilst inhibiting axial movement thereof.

Advantageously, said apparatus comprises a lug for attachment to a pipe handling arm.

Preferably, said guide comprises a clamp.

The present invention also provides a pipe handling arm provided with an apparatus in accordance with the present invention.

The present invention also provides a method of handling a tubular to be connected to another tubular, which method comprises the steps of:

gripping said tubular with an apparatus in accordance with the present invention, and using said apparatus to align said tubular with said another tubular.

Figure 1B:
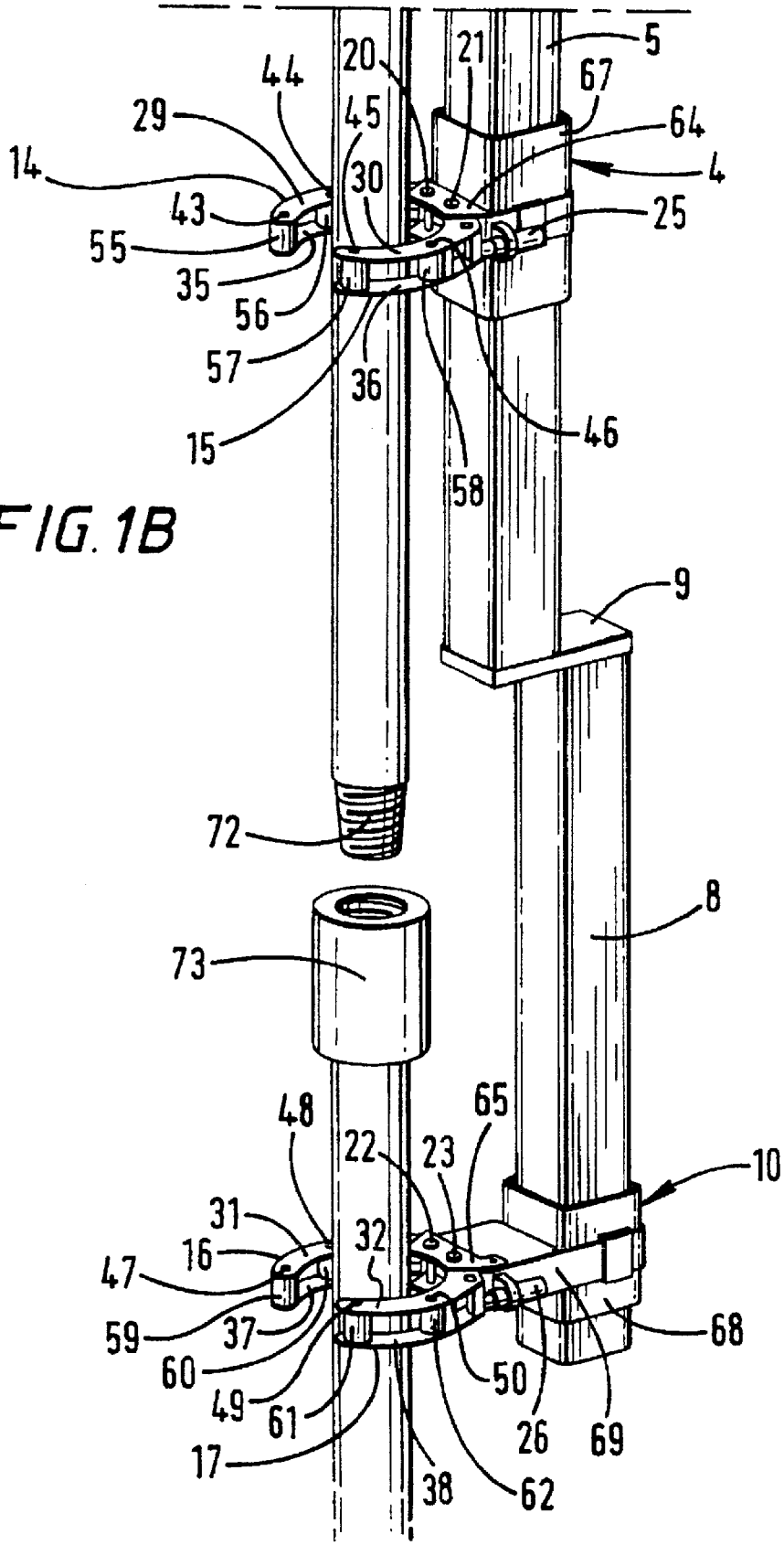

For a better understanding of the present invention, reference will now be made, by way of example, to the accompanying drawings in which:

FIG. 1A shows a top portion of an apparatus according to the present invention in use; and FIG. 1B shows a bottom portion of the apparatus according to the present invention in use.

Referring to the drawings there is shown an apparatus which is generally identified by reference numeral 1.

The apparatus 1 comprises a substantially vertical box-section upper strut 2 which has longitudinally spaced upper and lower clamping units 3 and 4 slidably mounted thereon. The upper and lower clamping units 3 and 4 are linked by a bar 5. The upper clamping unit 3 is attached to the piston of a hydraulic piston and cylinder 7. Activation of the hydraulic piston and cylinder 7 moves the upper and lower clamping units 3 and 4 along the upper strut 2.

A substantially vertical box-section lower strut 8 is attached to the upper strut 2 by a plate 9. The lower strut 8 is set back from the upper strut 2. A guide in the form of a clamping unit 10 is arranged near the lower end of the lower strut 8.

The apparatus 1 is connectable to a standard pipe handling arm (not shown) in place of the known clamping device described hereinbefore via lug 11.

Each clamping unit 3, 4, 10 comprises two jaws 12, 13; 14, 15; 16, 17; each jaw 12 to 17 being pivotable about a respective pin 18, 19, 20, 21, 22, 23 by a hydraulic piston 24, 25, 26.

Each jaw 12 to 17 comprises an upper plate 27 to 32 and a lower plate 33 to 38 which are separated by bolts 39 to 50 onto which cylindrical rollers 51 to 62 are mounted so that the longitudinal axis of the cylindrical rollers 51 to 62 is substantially perpendicular to the upper and lower plates 27 to 38.

Each jaw 12 to 17 is attached to a lug 63, 64, 65. Lugs 63 and 64 are welded to respective sleeves 66 and 67 which are slidably arranged on the upper strut 2. Lug 65 is welded to an intermediary section 69 which in turn is welded to sleeve 68. The sleeve 68 is fixed to the lower strut 8 by grub screws (not shown). The sleeve 68 may however be moved along lower strut 8. The jaws 12 to 17 of the clamping units 3, 4, 10 are substantially in vertical alignment with each other, and preferably to within a tolerance of a few millimeters.

In use, the apparatus 1 is connected to a pipe handling arm via lug 11. The pipe handling arm is generally movable in three planes. Such pipe handling arms are currently supplied by Varco BJ™ such as the PLS-3™ Automatic pick-up/Laydowns system and Martine Hydraulics™ such as the Eagle™ and Eagle Light™ transfer system.

A tubular 70 to be connected to the upper end of a tubular string 71 is picked up by the jaws 12, 13, 14, 15 of the clamping units 3, 4 from a rack (not shown). The jaws 12, 13, 14, 15 of the clamping units 3, 4 move about pins 18, 19, 20, 21 by activation of the hydraulic pistons 24, 25. The rollers 51 to 58 engage with the tubular 70. The upper end of the tubular string 71 is held in a spider (not shown) in the rig floor (not shown). The tubular 70 is then brought into approximate alignment, for example within a few centimeters of the upper section of the tubular string 71 by manipulation of the pipe handling arm to which apparatus 1 is connected.

The jaws 16, 17 of the clamping unit 10 move about pins 22, 23 by activation of the hydraulic pistons 26 and rollers 55 to 58 move circumjacent and engage the upper section of the tubular string 71. As the rollers 55 to 58 move into engagement with the tubular string 71 the tubular 70 moves into alignment with the tubular string 71, such movement being permitted by the "slack" in the pipe handling arm. The tubular 70 is now in alignment with the upper section of the tubular string 71 to preferably within a few millimeters. The tubular 70 can now be lowered by activating the hydraulic piston 7. A threaded pin 72 of the tubular 70 locates in the threaded box 73 of the upper section of the tubular string 71. The lower strut 8 is set back from the tubular 70 and the upper section of the tubular string 71, to allow a tong and a back-up tong (not shown) to be used to screw the threaded pin 72 into the threaded box 73 to make the connection. Alternatively, a top drive, (not shown) on the derrick may be used to screw the threaded pin 72 into the threaded box 73. The rollers 51 to 58 allow rotation of the tubular 70 whilst inhibiting a longitudinal movement thereof.

It is envisaged that various modifications may be made to the preferred embodiment including replacing hydraulic piston 7 with a pneumatic piston, which, with the appropriate control apparatus, will be able to compensate for the weight of the tubular 70 and minimise potential damage to the threads as the tubular 70 is lowered into the threaded box 73.

It should be noted that the clamp 10 could be replaced by a guide which could be slidable on the upper section of the tubular string 71 when closed thereabout. However, it is recommended that a clamp 10 should be used.

What is claimed is:

1. An apparatus for handling a first tubular and a second tubular, comprising:

a strut having a first portion and a second portion, wherein the first portion is offset from the second portion;

a clamp slidably disposed on the first portion; and a guide slidably disposed on the second portion, wherein the clamp and the guide are movable relative to each other in a direction longitudinal of the strut and the arrangement being such that the first tubular can be brought closer to the second tubular in a direction longitudinal of the strut and wherein the clamp and the guide are arranged in substantial alignment such that the first tubular is substantially aligned with the second tubular after engaging the clamp and the guide, respectively.

2. The apparatus of claim 1, wherein the clamp is movable along said strut using a piston and cylinder assembly.

3. The apparatus of claim 1, wherein the guide is movable along said strut using a piston and cylinder assembly.

4. The apparatus of claim 1, wherein the first portion is connected to the second portion using a plate.

5. The apparatus of claim 1, further comprising a secondary clamp which is in a fixed relation to the clamp.

6. The apparatus of claim 1, wherein the clamp comprises one or more jaws movable between an open position and a closed position.

7. The apparatus of claim 6, further comprising one or more hydraulic pistons for moving said jaws between the open and closed positions.

8. The apparatus of claim 6, wherein said jaws comprise one or more cylindrical rollers to facilitate rotation of the first tubular whilst inhibiting axial movement thereof.

9. The apparatus of claim 1, further comprising a lug for attachment to a pipe handling arm.

10. The apparatus of claim 1, wherein the guide comprises one or more jaws movable between an open position and a closed position.

11. The apparatus of claim 1, wherein the second tubular is held by a tubular handling device disposed in a rig floor.

12. An apparatus for connecting two tubulars, comprising:

a strut having a first portion and a second portion, wherein the first portion is offset from the second portion;

a first clamp movably disposed on the first portion; and a second clamp movably disposed on the second portion, wherein the first clamp and the second clamp are movable relative to each other in the same axial direction and arranged to substantially align the two tubulars for connection after engagement therewith.

13. The apparatus of claim 12, further comprising a piston and cylinder assembly for moving the first clamp.

14. The apparatus of claim 13, further comprising another piston and cylinder assembly for moving the second clamp.

15. The apparatus of claim 12, wherein the first clamp and the second clamp comprise one or more jaws movable between an open position and a closed position.

16. The apparatus of claim 15, wherein the first clamp and the second clamp further comprise one or more pistons for moving the jaws between the open position and the closed position.

17. The apparatus of claim 15, wherein the first clamp and the second clamp further comprise one or more rollers to facilitate rotation of the tubular while preventing axial movement thereof.

18. The apparatus of claim 12, wherein the first clamp and the second clamp comprise one or more jaws movable between an open position and a closed position.

19. The apparatus of claim 18, wherein the first clamp and the second clamp further comprise one or more pistons for moving the jaws between the open position and the closed position.

20. The apparatus of claim 19, wherein the first clamp and the second clamp further comprise one or more rollers to facilitate rotation of the tubular while preventing axial movement thereof.

21. The apparatus of claim 20, further comprising a third clamp movably disposed on the first portion.

22. The apparatus of claim 21, further comprising a piston and cylinder assembly for moving the first clamp.

23. The apparatus of claim 22, wherein moving the first clamp also moves the third clamp when the first clamp and the third clamp engage the tubular.

24. A method of handling a first tubular to be connected to a second tubular, comprising:

moving a tubular handling apparatus proximate the first tubular, the tubular handling apparatus comprising:

a strut having a first portion and a second portion, wherein the first portion is offset from the second portion;

a first clamp movably disposed on the first portion; and a second clamp movably disposed on the second portion, wherein the first clamp and the second clamp are movable relative to each other in the same axial direction;

aligning the first clamp with the second clamp;

gripping the first tubular using the first clamp;

gripping the second tubular with the second clamp, whereby the second tubular is substantially aligned with the first tubular after engaging the second clamp; and moving the first tubular closer to the second tubular.

25. The method of claim 24, wherein the tubular handling apparatus further comprising a piston and cylinder assembly for moving the first clamp.

26. The method of claim 25, wherein moving the first tubular closer to the second tubular is performed using the piston and cylinder assembly.

27. The method of claim 24, wherein the first clamp comprises one or more jaws movable between an open position and a closed position.

28. The method of claim 27, wherein gripping the first tubular using the first clamp comprises moving the one or more jaws of the first clamp from the open position to the closed position.

29. The method of claim 28, wherein a piston is used to move the one or more jaws of the first clamp from the open position to the closed position.

30. The method of claim 24, wherein the second tubular is held by a tubular handling device disposed in a rig floor.

31. A pipe handling arm having one fixable end and one end free to move in at least one plane, the free end having attached thereto a clamp for gripping a first tubular, characterized in that the clamp has associated therewith a guide for alignment with a second tubular prior to interconnection of the first and second tubulars, the clamp and the guide arranged on a strut having a first portion offset from a second portion, wherein the clamp is disposed on the first portion and the guide is disposed on the second portion, the clamp and the guide being movable relative to each other in a direction longitudinal of the first tubular and substantially aligns the first tubular with the second tubular after engaging the respect tubulars so that the first tubular can be brought closer to the second tubular in a direction longitudinal of the first tubular.

32. A pipe handling arm as claimed in claim 31, wherein at least one of said clamp and said guide is movable along said strut by a hydraulic piston and cylinder.

33. A pipe handling arm as claimed in claim 31, wherein at least one of said clamp and said guide is movable along said strut by a pneumatic piston and cylinder.

34. A pipe handling arm as claimed in claim 31, further comprising a second clamp which is in a fixed relation to said clamp.

35. A pipe handling arm as claimed in claim 31, wherein the clamp comprises one or more jaws movable between an open and a closed position.

36. A pipe handling arm as claimed in claim 35, further comprising a hydraulic piston for moving said one or more jaws between their open and closed positions.

37. A pipe handling arm as claimed in claim 35, wherein said one or more jaws comprise at least one cylindrical roller to facilitate rotation of said first tubular whilst inhibiting axial movement thereof.

38. A pipe handling arm as claimed in claim 31, wherein said guide comprises a clamp.

* * * * *